US010487288B2

(12) United States Patent
Skinner et al.

(10) Patent No.: US 10,487,288 B2
(45) Date of Patent: Nov. 26, 2019

(54) ADDITIVE CONCENTRATES FOR THE FORMULATION OF LUBRICATING OIL COMPOSITIONS

(71) Applicant: Infineum International Limited, Abingdon (GB)

(72) Inventors: Philip Skinner, Oxfordshire (GB); Daniel Whyte, Berkshire (GB); Peter D. Watts, Oxfordshire (GB); Jacob Emert, Brooklyn, NY (US)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

(21) Appl. No.: 14/855,769

(22) Filed: Sep. 16, 2015

(65) Prior Publication Data

US 2017/0073607 A1 Mar. 16, 2017

(51) Int. Cl.
*C10M 141/06* (2006.01)
*C10M 161/00* (2006.01)
*C10M 169/04* (2006.01)

(52) U.S. Cl.
CPC ..... *C10M 161/00* (2013.01); *C10M 141/06* (2013.01); *C10M 169/045* (2013.01); *C10M 2207/028* (2013.01); *C10M 2207/262* (2013.01); *C10M 2215/28* (2013.01); *C10M 2219/089* (2013.01); *C10N 2210/02* (2013.01); *C10N 2230/04* (2013.01); *C10N 2230/52* (2013.01); *C10N 2240/10* (2013.01); *C10N 2240/102* (2013.01); *C10N 2270/02* (2013.01)

(58) Field of Classification Search
CPC ..... C10M 2215/28; C10M 2219/046; C10M 159/22
USPC ..... 508/287, 391, 460
See application file for complete search history.

(56) References Cited

U.S. PATENT DOCUMENTS

| | | | | |
|---|---|---|---|---|
| 3,087,936 | A | 4/1963 | Le Suer | |
| 3,254,025 | A | 5/1966 | Le Suer | |
| 4,702,850 | A | 10/1987 | Gutierrez et al. | |
| 4,927,551 | A | 5/1990 | Erdman et al. | |
| 4,938,881 | A | 7/1990 | Ripple et al. | |
| 5,230,714 | A | 7/1993 | Steckel | |
| 5,241,003 | A | 8/1993 | Degonia et al. | |
| 5,565,128 | A | 10/1996 | Gutierrez | |
| 5,616,816 | A | 4/1997 | Burjes et al. | |
| 5,714,443 | A | 2/1998 | Cane et al. | |
| 5,716,914 | A | 2/1998 | Cane et al. | |
| 5,756,431 | A | 5/1998 | Emert et al. | |
| 5,792,730 | A | 8/1998 | Gutierrez et al. | |
| 5,808,145 | A | 9/1998 | Le Coent et al. | |
| 5,854,186 | A | 12/1998 | Cusumano et al. | |
| 6,001,785 | A | 12/1999 | Le Coent et al. | |
| 6,034,039 | A | 3/2000 | Gomes et al. | |
| 6,090,759 | A | 7/2000 | Cane et al. | |
| 6,090,760 | A | 7/2000 | Cane et al. | |
| 6,153,565 | A | 11/2000 | Skinner et al. | |
| 6,200,936 | B1 | 3/2001 | Moreton | |
| 6,417,148 | B1 | 7/2002 | Skinner et al. | |
| 6,429,179 | B1 * | 8/2002 | Skinner | C07G 17/00 134/40 |
| 7,462,583 | B2 | 12/2008 | Wilk et al. | |
| 7,776,233 | B2 | 8/2010 | Arafat et al. | |
| 7,820,076 | B2 | 10/2010 | Arafat et al. | |
| 2004/0121918 | A1 * | 6/2004 | Rea | C10M 167/00 508/291 |
| 2007/0027057 | A1 | 2/2007 | Le Coent et al. | |
| 2010/0081591 | A1 * | 4/2010 | Yamaguchi | C10M 163/00 508/198 |
| 2011/0053814 | A1 * | 3/2011 | Tobias | C10M 163/00 508/287 |

FOREIGN PATENT DOCUMENTS

| | | | |
|---|---|---|---|
| CN | 104531273 | A | 4/2015 |
| WO | WO-97/46643 | A1 | 12/1997 |

OTHER PUBLICATIONS

American Petroleum Institute, Engine Oil Licensing and Certification System, Industry Services Dept., API 1509, 14th Edition, Dec. 1996, Addendum 1, Dec. 1998.

W.W. Yau, J.J. Kirkland, D.D. Bly, Modern Size Exclusion Liquid Chromatography, John Wiley & Sons, New York 1979.

* cited by examiner

*Primary Examiner* — Vishal V Vasisth

(57) ABSTRACT

A lubricant additive concentrate containing 30 to 80 mass % oil of lubricating viscosity and from 20 to 70 mass % of additive; wherein from 30 to 90 mass % of the additive is (i) hybrid overbased colloidal detergent derived from sulfonate surfactant and hydroxybenzoate surfactant; and (ii) polyalkenyl succinimide dispersant derived from a polyalkene having a number average molecular weight ($M_n$) of from 1300 to 2500 daltons, and wherein the mass ratio of polyalkenyl succinimide dispersant (ii) to hybrid overbased colloidal detergent (i) in the lubricant additive is from 25:1 to 1:1.

6 Claims, No Drawings

ADDITIVE CONCENTRATES FOR THE FORMULATION OF LUBRICATING OIL COMPOSITIONS

The present invention relates to storage stable additive concentrates for the formulation of lubricating oil compositions, which additive concentrates contain dispersant and colloidal hybrid detergent derived from two or more surfactants.

BACKGROUND OF THE INVENTION

Crankcase lubricants for passenger car and heavy duty diesel engines contain numerous additives providing the lubricant with an array of performance properties required for optimum function and protection of the respective engines. Each individual additive is requires to provide the performance benefit for which it was designed without interfering with the function of the other additives in the lubricant. Within each additive class (e.g. dispersant or detergent) a number of options are available that differ in structure, such as molecular weight, metal type, hydrophobic/hydrophilic balance, etc. The selection of the additives for any given formulation must take into account both the relative performance characteristics of the individual additives, as well as synergies or antagonisms with other additives present in the oil.

Additive packages containing multiple additives are typically sold to lubricant formulators in the form of concentrates, to enable the introduction of a range of base stocks to target different viscosity grades, performance levels and costs. This leads to further complications in that the selected additives must be compatible with each other in the concentrate to avoid additive package instability and phase separation.

In some cases, the most desirable additive structure from a performance standpoint interacts more strongly in the concentrate compared to other alternatives. The use of a combination of overbased colloidal sulfonate and hydroxybenzoate (such as salicylate) detergents is an example. A combination of overbased colloidal sulfonate and hydroxybenzoate detergents, together with high molecular weight succinimide dispersants, has been found to provide optimal cleanliness and acid neutralization efficiency, together with high molecular weight succinimide dispersants for sooted oil rheology control in crankcase lubricating oil compositions for heavy duty diesel (HDD) engines. These additives, however, exhibit incompatibilities that limit the combined use thereof in the form of an additive concentrate. Surprisingly, it has now been found that, while the combination of a high molecular weight succinimide dispersant and conventional overbased colloidal hydroxybenzoate and sulfonate detergents result in an additive concentrate results in concentrate stability issues, high molecular weight succinimide dispersant and an overbased colloidal hybrid detergent derived from a mixture of hydroxybenzoate and sulfonate surfactants are compatible and that additive concentrates containing such dispersants and detergents remain stable over a range of compositions.

SUMMARY OF THE INVENTION

In accordance of a first aspect of the invention, there is provided a lubricant additive concentrate comprising from about 30 to about 80 mass % oil of lubricating viscosity and from about 20 to about 70 mass % of additive; wherein from about 30 to about 90 mass % of said additive comprises, on an active ingredient (AI) basis (i) hybrid overbased colloidal detergent derived from sulfonate surfactant and hydroxybenzoate surfactant; and (ii) polyalkenyl succinimide dispersant derived from a polyalkene having a number average molecular weight ($M_n$) of from about 1300 to about 2500 daltons, and wherein the mass ratio of polyalkenyl succinimide dispersant (i) to hybrid overbased colloidal detergent (ii) in the lubricant additive concentrate is from about 25:1 to about 1:1.

In accordance with a second aspect of the invention, there is provided a lubricant additive concentrate, as in the first aspect, comprising from about 0.5 to about 25 mass %, based on the total mass of concentrate, and on an active ingredient (AI) basis, of hybrid overbased colloidal detergent (i); and from about 5 to about 60 mass %, based on the total mass of concentrate, and on an active ingredient (AI) basis, of polyalkenyl succinimide dispersant (ii).

In accordance with a third aspect of the invention, there is provided a lubricant additive concentrate, as in the first or second aspect, wherein the sulfonate and hydroxybenzoate surfactants from which hybrid overbased colloidal detergent (i) is derived are Mg- or Ca-based surfactants, or a mixture thereof.

In accordance with a fourth aspect of the invention, there is provided a lubricant additive concentrate, as in the first, second or third aspect, wherein the hydroxybenzoate surfactant from which hybrid overbased colloidal detergent (i) is derived is salicylate surfactant.

In accordance with a fifth aspect of the invention, there is provided a lubricant additive concentrate, as in the first, second, third or fourth aspect, wherein the concentrate further contains a low molecular weight hydrocarbyl- or hydrocarbenyl-substituted succinimide or succinic anhydride compatibility aid, derived from a hydrocarbyl or hydrocarbenyl group having a number average molecular weight ($M_n$) of from about 150 to about 1200 daltons, such as octadecenyl succinic anhydride (ODSA) or polyisobutenyl succinic anhydride (PIBSA), preferably in an amount of from about 0.25 to about 8 mass % (on an AI, basis).

Other and further objects, advantages and features of the present invention will be understood by reference to the following specification.

DETAILED DESCRIPTION OF THE INVENTION

Overbased metal detergents consist of an alkali or alkaline earth metal hydroxide or carbonate core and surfactant outer shell (alkali or alkaline earth metal salts of organic acids). The aforementioned metal salts may contain a substantially stoichiometric amount of the metal when they are usually described as normal or neutral salts and would typically have a total base number or TBN of from 0 to 80 mg KOH/g (in diluted form). Large amounts of a metal base can be included by reaction of an excess of a metal compound, such as an oxide or hydroxide, with an acidic gas such as carbon dioxide. This results in 'overbasing', where neutralized surfactant stabilizes a colloidal alkali or alkaline earth metal hydroxide or carbonate core. Such overbased detergents may have a TBN of 150 mg KOH/g or greater, and typically of from 250 to 500 mg KOH/g or more (in diluted form).

A 'hybrid' or 'complex' detergent describes an additive where two or more surfactant chemistries are used to stabilize a colloidal alkali or alkaline earth metal carbonate or hydroxide core. These may be prepared by standard overbased detergent synthesis techniques such as described in the art. Hybrid detergents derived from sulfonate and salicylate surfactants were first described in GB Patent No. 786167A (1957), and corrosion inhibitors derived from a mixture of sulfonate and salicylate surfactants are described in U.S. Pat. Nos. 7,776,233; and 7,820,076. Other hybrid detergents, specifically calcium hybrid detergents derived from phenate surfactant and at least one other type of surfactant, are described in U.S. Pat. Nos. 6,034,039; 6,153,565; 6,417,148; and 6,429.179.

The hybrid overbased colloidal detergents (i) of the present invention are derived from mixed hydrocarbyl-substituted hydroxybenzoate/hydrocarbyl-substituted sulfonate systems and have a "metal ratio", i.e. ratio of colloidal alkaline earth metal (typically calcium or magnesium) to neutral surfactant, in moles, typically in the range of 3:1 to 15:1, with a TBN range of from about 300 to about 700 mg KOH/g (on an AI basis).

As used herein, "hydrocarbyl" means a group or radical that contains carbon and hydrogen atoms bonded to the remainder of the molecule via a carbon atom. It may contain hetero atoms, i.e. atoms other than carbon and hydrogen, provided they do not alter the essentially hydrocarbon nature and characteristics of the group. As examples of hydrocarbyl, there may be mentioned alkyl and alkenyl.

Hydrocarbyl-substituted hydroxybenzoate surfactant is derived from hydroxybenzoic acids. Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulfurized or sulfurized, and may be chemically modified and/or contain additional substituents. Processes for sulfurizing a hydrocarbyl-substituted hydroxybenzoic acid are well known to those skilled in the art, and are described, for example, in US 200710027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 24, carbon atoms.

Preferably, the hydrocarbyl-substituted hydroxybenzoate surfactant is hydrocarbyl-substituted salicylate surfactant derived from hydrocarbyl substituted salicylic acid. As with hydrocarbyl-substituted hydroxybenzoic acids generally, the preferred substituents in oil-soluble salicylic acids are alkyl substituents, and in alkyl-substituted salicylic acids, the alkyl groups advantageously contain 5 to 100, preferably 9 to 30, especially 14 to 24, carbon atoms. Where there is more than one alkyl group, the average number of carbon atoms in all of the alkyl groups is preferably at least 9 to ensure adequate oil solubility.

The hydrocarbyl-substituted sulfonate surfactant may be prepared from sulfonic acids which are typically obtained by the sulfonation of hydrocarbyl-substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The sulfonate hydroxybenzoate ratio (mole:mole) in the hybrid overbased colloidal detergents (i) may be from about 1:20 to 20:1 (sulfonate:hydroxybenzoate), but are preferably from about 1:10 to about 2:1, such as from about 1:5 to about 1:1, more preferably from about 1:4 to about 1:2. Preferably, the metal is calcium, magnesium or a mixture thereof.

Lubricant additive concentrates of the present invention may contain from about 0.5 to about 25 mass % (on an AI basis), such as from about 2 mass % to about 25 mass % of hybrid overbased colloidal detergents (i), and preferably contain from about 2 to 20 mass % such as from about 3 to about 15 mass %, or from about 4 to about 14 mass % of hybrid overbased colloidal detergents (i).

Lubricant additive concentrates of the present invention may contain neutral detergents and overbased detergents not of the present invention, as well as hybrid overbased colloidal detergents (i) of the present invention, however, hybrid overbased colloidal detergents (i) of the present invention constitute at least 20 mass %, or at least 30 mass % or at least 40 mass %, or at least 50 mass % of the total mass of colloidal detergent in the concentrate.

These neutral detergents and other overbased detergents include single surfactant detergents derived from (a) sulfonate; (b) phenate; and (c) hydroxybenzoate (e.g., salicylate) surfactants. The term "phenate", as used herein with reference to surfactant type, is also intended to include alkyl-bridged phenol condensates, as described, for example, in U.S. Pat. No. 5,616,816; bridged or unbridged phenol condensates substituted with —CHO or $CH_2OH$ groups, sometimes referred to as "saligenin", as described, for example, in U.S. Pat. No. 7,462,583 as well as phenates that have been modified by carboxylic acids, such as stearic acid, as described, for example, in U.S. Pat. Nos. 5,714,443; 5,716,914; 6,090,759. The term "hydroxybenzoate", as used herein with reference to surfactant type, is intended to include salicylates, so-called "phenalates", as described, for example, in U.S. Pat. Nos. 5,808,145; and 6,001,785, and optionally substituted bridged phenol/salicylate condensates, sometimes referred to as "salixarates", which are described, for example, in U.S. Pat. No. 6,200,936.

Dispersants useful in the context of the present invention are polyalkenyl (preferably polybutenyl) succinimide dispersants that are the reaction product of a polyamine and polyalkenyl succinic anhydride (PIBSA) derived from polybutene having a number average molecular weight ($M_n$) of greater than about 1300 daltons, and preferably greater than 1800 daltons, and less than about 2500 daltons such as less than about 2400 daltons. The polybutenyl succinic anhydride (PIBSA) may be derived via a thermal or "ene" maleation process from succinic and/or maleic anhydride and polybutene having a terminal vinylidene content of at least about 50%, 60%, 70%, or 80%, or may be derived from succinic and/or maleic anhydride and conventional polybutene via a chlorine-assisted maleation process.

The dispersants of the present invention preferably have a functionality of from about 1.1 to about 2.2, such as a functionality of from about 1.2 to about 2.0, more preferably from about 1.3 to about 1.9. Functionality (F) can be determined according to the following formula:

$$F=(SAP\times M_n)/((1122\times A.I.)-(SAP\times MW)) \quad (1)$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer (e.g., polybutene); A.I. is the percent active ingredient of the succinic-containing reaction product (the remainder being unreacted olefin polymer and diluent); and MW is the molecular weight of the dicarboxylic acid-producing moiety (98 for maleic anhydride). Generally, each dicarboxylic acid-producing moiety (succinic group) will react with a nucleophilic group (polyamine moiety) and the number of succinic groups in the PIBSA will determine the number of nucleophilic groups in the finished dispersant.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

To provide the required functionality, the monounsaturated carboxylic reactant, (maleic anhydride), typically will be used in an amount ranging from about 10 to about 300 wt. % excess, preferably from about 50 to 200 wt. % excess, based on the moles of polymer. Unreacted excess monounsaturated carboxylic reactant can be removed from the final dispersant product by, for example, stripping, usually under vacuum, if required.

Polyamines useful in the formation of the dispersants of the present invention include polyamines having, or having on average, 3 to 8 nitrogen atoms per molecule, preferably from about 5 to about 8 nitrogen atoms per molecule. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Mixtures of amine compounds may advantageously be used, such as those prepared by reaction of alkylene dihalide with ammonia. Preferred amines are aliphatic saturated amines, including, for example, polyethylene amines such as diethylene triamine; triethylene tetramine; tetraethylene pentamine; and polypropyleneamines such as di-(1,2-propylene) triamine. Such polyamine mixtures, known as PAM, are commercially available. Useful polyamine mixtures also include mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Preferably, the dispersants of the present invention have a coupling ratio of from about 0.7 to about 1.3, preferably from about 0.8 to about 1.2, most preferably from about 0.9 to about 1.1. In the context of this disclosure, "coupling ratio" may be defined as a ratio of succinyl groups in the PIBSA to primary amine groups in the polyamine reactant.

Lubricant additive concentrates of the present invention may contain polymeric dispersant additives other than the high molecular weight dispersant of the present invention, such as polybutenyl succinimide reaction products of a polyamine and polybutenyl succinic anhydride (PIBSA), which are derived from polybutene having a number average molecular weight ($M_n$) of less than 1300, however, dispersant (ii) of the present invention preferably constitutes at least 30 mass %, such as at least 40 mass %, more preferably at least 50 mass %, such as at least 60 or 70 or 75 mass 0 of the total mass of dispersant in the concentrate. The "other polymeric dispersant additives" may also include dispersants derived from polymers other than polybutene, such as polypropylene polymers, ethylene-propylene copolymers or ethylene-butene copolymers grafted with maleic anhydride and copolymers of butene and maleic anhydride.

Either or each of the high molecular weight, high functionality dispersant of the present invention and the "other polymeric dispersant additives" may be post treated by a variety of conventional post treatments such as boration, as generally taught in U.S. Pat. Nos. 3,087,936 and 3,254,025. Boration of the dispersant is readily accomplished by treating an acyl nitrogen-containing dispersant with a boron compound such as boron oxide, boron acids, and esters of boron acids, in an amount sufficient to provide from about 0.1 to about 20 atomic proportions of boron for each mole of acylated nitrogen composition. Useful dispersants contain from about 0.05 to about 2.0 mass %, e.g., from about 0.05 to about 0.7 mass % boron. The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding from about 0.5 to 4 mass %, e.g., from about 1 to about 3 mass % (based on the mass of acyl nitrogen compound) of a boron compound, preferably boric acid, usually as a slurry, to the acyl nitrogen compound and heating with stirring at from about 135° C. to about 190° C., e.g., 140° C. to 170° C., for from about 1 to about 5 hours, followed by nitrogen stripping. Alternatively, the boron treatment can be conducted by adding boric acid to a hot reaction mixture of the dicarboxylic acid material and amine, while removing water. Other post reaction processes commonly known in the art can also be applied. Preferably, the high molecular weight, high functionality dispersant of the present invention is not borated.

Lubricant additive concentrates of the present invention may contain from about 5 to about 60 mass % (on an AI basis), such as from about 10 mass % to about 50 mass % of polyalkenyl succinimide dispersant (ii).

The lubricant additive concentrates of the present invention may optionally further contain a low molecular weight hydrocarbyl or hydrocarbenyl succinimide or succinic anhydride compatibility aid, derived from a hydrocarbyl or hydrocarbenyl group having a number average molecular weight (M) of from about 150 to about 1200 daltons, such as octadecenyl succinic anhydride (ODSA) or polyisobutenyl succinic anhydride (PIBSA). The PIBSA compatibility aid, or PIBSA from which the low molecular weight succinimide compatibility aid is derived may be formed via either a thermal "ene" reaction, or using a halogen (e.g., chlorine) assisted alkylation process.

Oils of lubricating viscosity that may be used as the diluent in the additive concentrates of the present invention may be selected from natural lubricating oils, synthetic lubricating oils and mixtures thereof. Generally, the viscosity of these oils ranges from about 2 $mm^2$/sec (centistokes) to about 40 $mm^2$/sec, especially from about 4 $mm^2$/sec to about 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The diluent oil may comprise a Group I, Group II, Group III, Group IV or Group V base stocks or blends of the aforementioned base stocks. Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998.

The lubricant additive concentrates of the present invention comprise from about 30 mass % to about 80 mass % of diluent oil and from about 70 mass % to about 20 mass %, preferably from about 70 mass % to about 30 mass %, such as about 60 mass % to about 35 mass % of additive, on an AI basis, with the hybrid overbased colloidal detergent (i) and polyalkenyl succinimide dispersant (ii) together comprising from about 30 mass % to about 90 mass %, such as from about 40 mass % to about 80 mass %, or from about 45 to about 75 mass % of the total additive fraction. The mass ratio of polyalkenyl succinimide dispersant (ii) to hybrid overbased colloidal detergent (i) in the lubricant additive concentrates of the present invention is from about 25:1 to 1:1, such as from about 20:1 to about 1.5:1, or from about 15:1 to about 2:1.

If additional stabilization of the lubricant additive concentrate is required, from about 0.25 mass % to about 8 mass % (on an A.I. basis), preferably from about 0.5 or about 1 mass % to about 5 mass % of one or more of the above described compatibility aid(s) may be substituted for an equal amount of base oil. It is noted that, if a compatibility aid is to be added to the lubricant additive concentrate of the present invention, it should not be introduced into the concentrate without the detergent being present. If the compatibility aid is introduced together with the dispersant in the absence of the detergent, the efficacy of the compatibility aid may be reduced.

Additional additives may be incorporated into the compositions of the invention to enable particular performance requirements to be met. Examples of additives which may be included in the lubricating oil compositions of the present invention are metal rust inhibitors, viscosity index improvers, corrosion inhibitors, oxidation inhibitors, organic friction modifiers, non-organic friction modifiers, anti-foaming agents, anti-wear agents and pour point depressants. Some are discussed in further detail below.

Dihydrocarbyl dithiophosphate metal salts are frequently used as antiwear and antioxidant agents. The metal may be an alkali or alkaline earth metal, or aluminum, lead, tin, molybdenum, manganese, zinc, nickel or copper. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, aromatic amines having at least two aromatic groups attached directly to the nitrogen (e.g., di-phenyl amines), alkaline earth metal salts of alkylphenolthioesters having preferably $C_5$ to Cu alkyl side chains, calcium nonylphenol sulfide, oil soluble phenates and sulfurized phenates, phosphosulfurized or sulfurized hydrocarbons or esters, phosphorous esters, metal or ashless thiocarbamates, oil soluble copper compounds as described in U.S. Pat. No. 4,867,890, and molybdenum-containing compounds.

Ashless (metal-free) organic friction modifiers, when present, may be any conventional ashless organic lubricating oil friction modifier. Examples of suitable ashless organic friction modifiers include monomeric friction modifiers that include a polar terminal group (e.g. carboxyl or hydroxyl or aminic) covalently-bonded to a monomeric oleophilic hydrocarbon chain. The monomeric olephilic hydrocarbon chain suitably comprises 12 to 36 carbon atoms. Suitably, the monomeric olephilic hydrocarbon chain is predominantly linear, for example at least 90% linear. The monomeric olephilic hydrocarbon chain is suitably derived from an animal or vegetable fat. The ashless organic friction modifier may comprise a mixture of ashless organic friction modifiers.

Suitable ashless nitrogen-free organic friction modifiers include esters formed by reacting carboxylic acids and anhydrides with alkanols. Esters of carboxylic acids and anhydrides with alkanols are described in U.S. Pat. No. 4,702,850. Preferred ashless organic nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and di-amines. One common class of such ashless nitrogen-containing friction modifier comprises ethoxylated alkyl amines, such as ethoxylated tallow amine. Such friction modifiers may also be in the form of an adduct or reaction product with a boron compound such as a boric oxide, boron halide, metabolite, boric acid or a mono-, di- or tri-alkyl borate.

Another ashless aminic friction modifier is an ester formed as the reaction product of (i) a tertiary amine of the formula $R_1R_2R_3N$ wherein $R_1$, $R_2$ and $R_3$ represent aliphatic hydrocarbyl, preferably alkyl, groups having 1 to 6 carbon atoms, at least one of $R_1$, $R_2$ and $R_3$ having a hydroxyl group, with (ii) a saturated or unsaturated fatty acid having 10 to 30 carbon atoms. Preferably, at least one of $R_1$, $R_2$ and $R_3$ is an alkyl group. Preferably, the tertiary amine will have at least one hydroxyalkyl group having 2 to 4 carbon atoms. The ester may be a mono-, di- or tri-ester or a mixture thereof, depending on how many hydroxyl groups are available for esterification with the acyl group of the fatty acid. A preferred embodiment comprises a mixture of esters formed as the reaction product of (i) a tertiary hydroxy amine of the formula $R_1R_2R_3N$ wherein $R_1$, $R_2$ and $R_3$ may be a $C_2$-$C_4$ hydroxy alkyl group with (ii) a saturated or unsaturated fatty acid having 10 to 30 carbon atoms, with a mixture of esters so formed comprising at least 30-60, preferably 45-55, such as 50, mass % diester; 10-40, preferably 20-30, e.g. 25, mass % monoester; and 10-40, preferably 20-70, such as 25, mass % triester. Suitably, the ester is a mono-, di- or tri-carboxylic acid ester of triethanolamine and mixtures thereof.

Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26.

Ashless organic friction modifiers, when desired, are suitably present in a concentrate in an amount of at least 0.5, preferably at least 1.0 and more preferably at least 1.5 mass %, based on the mass of the additive package.

One preferred class of ashless organic friction modifiers comprise one or more hydroxyalkyl alkyl amines of $C_{14}$ to $C_{24}$ at hydrocarbon, one or more ester amines derived from triethanol amine having a $C_{13}$ to $C_{23}$ hydrocarbyl substituent, or a mixture thereof. A particularly preferred organic friction modifier is a triethanol amine ester friction modifier (TEEMA).

Non-organic friction modifiers include oil-soluble organo-molybdenum compounds. Such organo-molybdenum friction modifiers also provide antioxidant and antiwear credits to a lubricating oil composition. Oil soluble organo-molybdenum compounds, include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates. Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene; isoprene, styreneibutadiene, and isoprene/butadiene, as well as the partially hydrogenated homopolymers of butadiene and isoprene.

A dispersant-viscosity index improver functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated monocarboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralized with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with amine, hydroxyl amine or alcohol.

Pour point depressants, otherwise known as lube oil flow improvers (LOFT), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

The total additive content of the lubricant additive concentrates of the present invention can be from about 20 mass to about 70 mass %, such as from about 35 mass to about 60 mass %, based on the total mass of the concentrate. To insure acceptable handling ability, the lubricant additive concentrates of the present invention preferably have a kinematic viscosity at 100° C. ($kv_{100}$) of less than about 300 cSt, such as less than about 250 cSt or less than about 200 cSt.

This invention will be further understood by reference to the following examples, wherein all parts are parts by weight, unless otherwise noted and which include preferred embodiments of the invention.

EXAMPLES

A series of additive concentrates were prepared using the following components in a Group I diluent basestock oil:

(i) a hybrid/complex salicylate/sulfonate overbased Mg detergent having a metal ratio of 5.5, a salicylate to sulfonate molar ratio of 2:1, and a TBN of 450 mg KOH/g on an A.I. basis;

an overbased Ca sulfonate detergent having a TBN of 550 mg KOH/g on an A.I. basis;

an overbased Mg sulfonate detergent having a TBN of 710 mg KOH/g on an A.I. basis;

an overbased Ca salicylate detergent having a TBN of 580 mg KOH/g on an A.I. basis;

(ii) an ashless succinimide dispersant; PIB Mn=2200, polyamine=PAM bottoms, prepared by chlorine-assisted maleation process Other Additives:

a zinc dialkyl dithiophosphate anti-wear additive;

organic and metallic anti-oxidant;

aromatic soot dispersant.

Long term storage stability of concentrates was assessed by storing the additive concentrates for a number of weeks (up to 12 weeks) at a temperature of 60° C. with periodic measuring of the amount of sediment formed. The results of the stability tests are shown in the following Table 1.

TABLE 1

| Component | Conc 1 | Conc 2 | Conc 3 | Conc 4 | Conc 5 |
|---|---|---|---|---|---|
| Succinimide Dispersant (mass % AI) | 22.3 | 21.7 | 21.3 | 22.4 | 22.6 |
| Overbased Ca Sulfonate (mass % AI) | 3.3 | 3.2 | — | — | — |
| Overbased Mg Sulfonate (mass % AI) | 4.2 | — | — | 4.2 | — |
| Overbased Ca Salicylate (mass % AI) | — | — | — | 3.1 | 6.8 |
| Overbased Hybrid (mass % AI) | — | 5.9 | 10.7 | — | — |
| Other Additives (mass % AI) | 17.8 | 17.4 | 17.0 | 17.9 | 18.0 |
| Diluent (mass %) | 52.4 | 51.8 | 51.0 | 52.4 | 52.6 |
| Conc Stab@ 12 wks (vol % sed) | 0.15 hazy | 0.1 clear | trace clear | 7 sl. haze | Trace hazy |

As shown, the additive concentrates of the present invention, containing overbased sulfonate/salicylate hybrid detergent (Conc 3) remained completely stable (i.e., no phase separation), whereas the analogous concentrate prepared with separate overbased sulfonate and overbased salicylate detergents (Conc 4) was unstable with significant phase separation (7% phase separation). Concentrates containing only overbased sulfonate detergent (Conc 1) or only overbased salicylate detergent (Conc 5) had no storage stability issues (trace to 0.15% phase separation). Concentrates of the present invention, containing the overbased sulfonate/salicylate hybrid detergent, were also shown to be stable (trace to 0.1% phase separation) in the presence of an additional amount of non-hybrid overbased detergent (Conc 2).

It should be noted that the lubricant additive concentrates and lubricating oil compositions of this invention comprise defined, individual, i.e., separate, components that may or may not remain the same chemically before and after mixing. Thus, it will be understood that various components of the composition, essential as well as optional and customary, may react under the conditions of formulation, storage or use and that the invention also is directed to, and encompasses, the product obtainable, or obtained, as a result of any such reaction.

The disclosures of all patents, articles and other materials described herein are hereby incorporated, in their entirety, into this specification by reference. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A lubricant additive concentrate comprising from about 30 to about 65 mass % oil of lubricating viscosity and from about 35 to about 70 mass % of additive; wherein from about 45 to about 75 mass % of said additive comprises, on an active ingredient (AI) basis (i) hybrid overbased colloidal detergent derived from sulfonate surfactant and salicylate surfactant and having a TBN, on an active ingredient (AI) basis of from about 300 to about 700 mg KOH/g; and (ii) polyalkenyl succinimide dispersant derived from a polyalkene having a number average molecular weight ($M_n$) of from about 1300 to about 2500 daltons; wherein said hybrid overbased colloid detergent has a metal ratio of from about 3:1 to about 15:1 and a sulfonate to salicylate mole:mole ratio of from about 1:5 to about 1:1, and wherein the sulfonate and salicylate surfactants from which said hybrid overbased colloidal detergent (i) is derived are Mg- or Ca-based surfactants, or a mixture thereof; wherein said concentrate comprises from about 4 to about 14 mass % (on an active ingredient (AI) basis) of said hybrid overbased colloid detergent (i) and from about 10 to about 40 mass % (on an active ingredient (AI) basis) of said polyalkenyl succinimide dispersant (ii); and wherein the mass ratio of said polyalkenyl succinimide dispersant (ii) to said hybrid overbased colloidal detergent (i) in said lubricant additive concentrate is from about 15:1 to about 1.5:1.

2. A lubricant additive concentrate of claim 1, further comprising a low molecular weight hydrocarbyl or hydrocarbenyl succinimide or succinic anhydride compatibility aid, derived from a hydrocarbyl or hydrocarbenyl group having a number average molecular weight ($M_n$) of from about 150 to about 1200 daltons.

3. A lubricant additive concentrate of claim 2, wherein said compatibility aid is octadecenyl succinic anhydride (ODSA) or polyisobutenyl succinic anhydride (PIBSA).

4. A lubricant additive concentrate of claim 2, wherein said compatibility aid is present in an amount of from about 0.25 to about 8 mass %.

5. A lubricant additive concentrate of claim 3, wherein said compatibility aid is present in an amount of from about 0.25 to about 8 mass %.

6. The lubricant additive concentrate of claim 1, further comprising at least one additional additive selected from the group consisting of zinc-phosphorus antiwear agents, molybdenum-containing antiwear agents and/or friction modifiers, ashless organic friction modifiers, antioxidants, viscosity modifiers and pour point depressants.

* * * * *